US005890272A

United States Patent [19]

Liberman et al.

[11] Patent Number: 5,890,272

[45] Date of Patent: Apr. 6, 1999

[54] PROCESS OF MAKING FINE METALLIC FIBERS

[75] Inventors: Michael Liberman; Alexander Sobolevsky, both of Deland; Raymond R. McNeice, Debary, all of Fla.

[73] Assignee: USF Filtration and Separations Group, Inc, Timonium, Md.

[21] Appl. No.: 968,691

[22] Filed: Nov. 12, 1997

Related U.S. Application Data

[60] Provisional application Nos. 60/030,661 Nov. 12, 1996 and 60/041,021 Mar. 19, 1997.

[51] Int. Cl.[6] ..... B23P 17/00

[52] U.S. Cl. ..... 29/419.1; 29/423; 29/424

[58] Field of Search ..... 29/419.1, 423, 29/424

[56] References Cited

U.S. PATENT DOCUMENTS

| | | |
|---|---|---|
| 2,077,682 | 4/1937 | Everett . |
| 3,239,919 | 3/1966 | Levi . |
| 3,277,564 | 10/1966 | Webber et al. . |
| 3,394,213 | 7/1968 | Roberts et al. . |
| 3,540,114 | 11/1970 | Roberts . |
| 3,785,036 | 1/1974 | Tada et al. . |
| 3,807,026 | 4/1974 | Takeo et al. . |
| 3,844,021 | 10/1974 | Hamada . |
| 3,864,807 | 2/1975 | Schneider et al. . |
| 3,882,587 | 5/1975 | Schneider et al. . |
| 4,209,122 | 6/1980 | Hunt . |
| 4,777,710 | 10/1988 | Hunt . |

*Primary Examiner*—S. Thomas Hughes
*Attorney, Agent, or Firm*—Frijouf, Rust & Pyle, P.A.

[57] ABSTRACT

A process for making fine metallic fibers comprising coating a plurality of metallic wires with a coating material. The plurality of metallic wires are jacketed with a tube for providing a cladding. The cladding is drawn for reducing the outer diameter thereof. The cladding is removed to provide a remainder comprising the coating material with the plurality of metallic wires contained therein. The remainder is drawn for reducing the diameter thereof and for reducing the corresponding diameter of the plurality of metallic wires contained therein. The coating material is removed for providing the plurality of fine metallic fibers.

29 Claims, 14 Drawing Sheets

PROCESS OF MAKING FINE METALLIC FIBERS

CROSS-REFERENCE TO RELATED APPLICATIONS

This application claims the benefit of U.S. Provisional application Ser. No. 60/030,661 filed Nov. 12, 1996 and U.S. Provisional application Ser. No. 60/041,021 filed Mar. 19, 1997. All subject matter set forth in application Ser. No. 60/030,661 and application Ser. No. 60/041,021 is hereby incorporated by reference into the present application as if fully set forth herein.

BACKGROUND OF THE INVENTION

1. Field Of The Invention

This invention relates to metallic fibers and more particularly to an improved method of making fine metallic fibers through a new cladding and drawing process.

2. Background of the Invention

In recent years, the need for high quality, small diameter metallic fibers has grown as new applications for such fibers are developed by the art. High quality, small diameter metallic fibers have been used in diverse applications such as filtration media as well as being dispersed within a polymeric material to provide electrostatic shielding for electronic equipment and the like. This need for high quality, small diameter metallic fibers has produced new ways and processes for making these high quality metallic fibers for the uses in the art.

Typically, high quality metallic fibers may be characterized as small diameter metallic fibers having a diameter of less than 50 micrometers with a substantially uniform diameter along the longitudinal length thereof. Typically, the fibers are produced in a fiber tow and severed to have a longitudinal length at least 1,000 times the diameter of the metallic fiber.

The metallic fibers as set forth herein are typically manufactured by cladding a metallic wire with a cladding material to provide a first cladding. The first cladding is drawn and annealed for reducing the diameter of the first cladding. A plurality of the first claddings are clad to provide a second cladding. The second cladding is subjected to a multiple drawing and annealing process for reducing the diameter of the second cladding and the corresponding diameter of the first claddings contained therein. Depending upon the desired end diameter of the first cladding, the plurality of second claddings may be clad to provide a third cladding. Multiple drawings of the third cladding reduces the diameter of the first and second claddings to provide metallic fibers within the first claddings of the desired diameter. After the desired diameter of the metallic fibers within the first cladding is achieved, the cladding materials are removed by either an electrolysis or a chemical process thereby providing metallic fibers of the desired final diameter.

Ideally, the metallic fibers are made of a stainless steel and are produced by a drawing process. The drawing process comprises cladding a stainless steel wire with a cold roll steel clad material to produce a first cladding. The first cladding is subjected to a series of drawing and annealing processes for reducing the diameter thereof. Thereafter, a plurality of the first claddings are encased within a second cladding material such as cold roll steel for producing a second cladding. The second cladding is subjected to a series of drawing and annealing processes for further reducing the diameter of the second cladding. After the drawing process, the original wires of the first cladding are reduced to a diameter of 10 to 50 microns that is suitable for some applications. For applications requiring finer metallic fibers, a plurality of second claddilngs are clad with a third cladding material to provide a third cladding. Third cladding is subjected to a series of drawing and annealing for further reducing the diameter of the original metallic wires. A triple cladding process can produce final wires having a diameter of as low as 6 microns in diameter.

The cladding material is removed by subjecting the finally drawn cladding to an acid leaching process whereby the acid dissolves the cladding material leaving the metallic fibers. The metallic fibers may be severed to produce metallic sliver or cut metallic fibers or may be used as metallic fiber tow.

Although the foregoing process of making fine metallic fibers has been found satisfactory in the prior art, the process has certain disadvantages for some applications. The first disadvantage is the requirement of incorporating a three cladding process in order to produce metallic fibers in the range of 6 microns in diameter. Another limitation is the initial diameter of the metallic wire must be of a sufficient size in order to clad carbon steel thereto. Another disadvantage of the aforementioned process includes the incomplete removal of the cladding material from the metallic fibers during the leaching process.

Another disadvantage of this prior art process is the diffusion of impurities of the carbon steel into the metallic fibers during the drawing process. A substantial amount of heat and pressure are produced during the drawing process causing a fusion of undesirable materials from the carbon steel upon the surface of the metallic fibers. These undesirable materials such as carbon, hydrocarbon materials such as oils and the like remain on the surface of the metallic fibers through the leaching process and reside thereon in the end product. In certain applications, these undesired impurities are detrimental to the application and the use of the metallic fibers. For example, these undesirable impurities may be detrimental when the metallic fibers are used in a filtration process or the like.

Some of the prior art have attempted to use copper as a cladding material for producing fine metallic fibers. U.S. Pat. No. 2,050,298 to Everett discloses a method for producing filaments from a rod, which comprises the steps of bundling the rods side by side in a matrix, drawing the bundle, removing the matrix, and separating the wires. The matrix serves to separate the elements, limiting distortion during drawing and preventing adjacent elements from becoming attached to each other. Two embodiments of matrix material given are metal powder and individual metal sheaths, or a combination of the two. The sheath may be dissolved off with acid. An example given consisted of stainless steel fibers having a copper matrix and a tubular casing of high carbon steel, the removal of which was effected by a hot acid bath. An alternative method for stainless steel fibers consisted of encasing the fibers in separate copper tubes and then packing a number of these in a copper tube.

U.S. Pat. No. 2,077,682 discloses a process for the production of fine wires, strips, thin sheets or the like by reduction from elements of larger cross-section which comprises assembling inside a tubular casing a plurality of metal elements composed of alloy steel comprising 0.05% to 0.20% carbon, 6% to 14% nickel and 10% to 20% chromium, and subjecting the encased elements as a unit to reducing operations to reduce the cross-section area of all the elements, simultaneously, and then removing the casing.

U.S. Pat. No. 3,066,384 discloses a method of making from 80" wide to 160" wide thin sheets of a metal to roll selected from the group consisting of stainless steel, ferrous alloys, titanium, zirconium and their alloys, which consists in assembling a pack of plates of the metal with weld-preventing material therebetween, placing the pack within a box welded up from steel top and bottom plates and steel side and end bars with the top and bottom plates overlapping the side and end bars, providing vent holes in all of the bars, hot rolling the resulting pack-in-a-box first by cross rolling and then by rolling longitudinally, thereby reducing the first-mentioned plates to sheets, then subjecting the sheets while still confined within the box to heating and cooling stages in predetermined order thereby developing desired physical properties in the sheets, roller leveling the hot-rolled pack while still in the box, and then opening the box and removing and separating the sheets.

U.S. Pat. No. 3,204,326 discloses a method of making a fused energy-conducting structure having a multiplicity of juxtaposed long and thin energy-conducting guides extending from one end toward the other end thereof utilizing a rolling mill, the method comprising the steps of placing a multiplicity of energy-conducting fibers each clad with a glass having a relatively low softening temperature and coefficient of expansion in side-by-side bundled relationship longitudinally within a tubular supporting member formed of a metal having a substantially higher softening temperature and coefficient of expansion than the glass, the fibers being in such number and of such diameter as to substantially fill the supporting member, there being undesired interstices containing air and gases extending longitudinally between the fibers, heating the assembly of the supporting member and fibers to a temperature sufficient to soften and fuse claddings together and rolling the heated assembly under compression progressively from one end toward the other end thereof to a reduced cross-sectional size, the reduction in size being of an amount at least sufficient to effect substantially complete closure of the interstices progressively along the length of the assembly and simultaneous longitudinal extrusion of air and gases therein immediately prior to adjoining and fusion of portions of the claddinigs along the interstices as the assembly is rolled.

U.S. Pat. No. 3,277,564 discloses a method of forming a tow of substantially bare filaments comprising the steps of sheathing each of a plurality of elongated drawable metal elements from which the filaments are to be formed with a tubular sheath formed of a material having characteristics permitting the sheaths to be pressed together to form a substantially monolithic body and differing chemically substantially from those of the elements to permit separation of the sheath material from elements. The sheathed elements are bundled in a substantially parallel relationship. The bundled sheathed elements are mechanically worked in at least one working step to reduce the cross-section of the elements to a preselected filament cross-section of less than approximately 10 microns maximum transverse dimension and to cause the sheath material to form a matrix extending substantially continuously in cross-section thereby to preclude separation of individual sheathed filaments. The sheathing material is substantially completely removed while maintaining the filaments in bundled relationship to provide a tow of substantially bare separate filaments.

U.S. Pat. No. 3,378,916 discloses a method of process for the production of superconducting niobium-zirconium alloy wire comprising heat-treating a niobium-zirconium material containing a second phase constituent and having a substantially non-dendritic refined crystal structure substantially free of high concentrations of impurities, in a temperature range of 1000°–1250° C. under inert conditions for 30–120 minutes, whereby the second phase is placed in solution with the material. The process includes quenching the material as quickly as possible to retain the second-phase constituents in solution and working the material at a temperature below 500° C. to reduce its cross section and removing any surface defects which may be present. The material is heat-treated at a temperature in the range of 750° C.–825° C. under inert conditions for 15–130 minutes and is enclosed within a sheath of different material having substantially similar working properties to the material regarding ductility, rate of work-hardening and hardness. The material is deformed within the sheath together to the required final cross-section of the material. The sheath is dissolved and the material is copper plated.

U.S. Pat. No. 3,394,213 discloses a method of forming fine filaments, such as filaments of under approximately 15 microns, in long lengths wherein a plurality of sheathed elements are firstly constricted to form a reduced diameter billet by means of hot forming the bundled filaments. After the hot forming constriction, the billet is then drawn to the final size wherein the filaments have the desired final small diameter. The material surrounding the filaments is then removed by suitable means leaving the filaments in the form of a tow.

U.S. Pat. No. 3,503,200 to Roberts et al. provides a method of forming a twisted bundle of filaments wherein a plurality of sheathed filaments are bundled together, sheathed or embedded in a matrix, and constricted by being drawn through a constricting die. Then the bundle is fed onto a roll, with a twist imparted to the filaments at the same time.

U.S. Pat. No. 3,540,114 discloses a method of forming fine filaments formed of a material such as metal by multiple end drawing a plurality of elongated elements having thereon a thin film of lubricant material. The plurality of elements may be bundled in a tubular sheath formed of a drawable material. The lubricant may be applied to the individual elements prior to the bundling thereof and may be provided by applying the lubricant to the elements while they are being individually drawn through a coating mechanism such as a drawing die. The lubricant comprises a material capable of forming a film having a high tenacity characteristic whereby the film is maintained under the extreme pressure conditions of the drawing process. Upon completion of the constricting operation, the tubular sheath is removed. If removed, the lubricant may also be removed from the resultant filaments.

U.S. Pat. No. 3,550,247 discloses carbon filaments being coated with a metal by electro-deposition, electroless plating or chemical plating. Preferably the carbon filaments are subjected to an oxidizing treatment under strong oxidizing conditions before being coated with the metal. Metal coated filaments are incorporated in the metal matrix by electroforming, powder technology techniques, casting or by subjecting the coated filaments to a combination of heat and pressure to coalesce them into a composite material.

U.S. Pat. No. 3,596,349 discloses a method of fabricating a unitary superconducting multistrand conductor. The method includes coating a plurality of fine superconducting wires with a normal metal having ductility characteristics similar with those of the superconducting metal, assembling the coated wires in a close-packed array, and swagging the array so that the metal coatings of the wires form a conductive continuous matrix in which the wires are solidly embedded.

U.S. Pat. No. 3,762,025 discloses a process for producing long continuous lengths of metallic filaments which comprises securing four flat plates of a first metal to each of the elongated sides of a billet of a second metal and having a cross section in shape of a rectangle, by edge welding each of the plates. The resulting assembly is essentially void free. The rectangular cross section of the billet is reduced while being elongated by hot rolling. The resulting elongated rectangular structure, having a core of the second metal and a cladding of the first metal over the elongated sides, is divided into a plurality of elements of the same lengths. The elements are inserted into a hollow metal tube open at both ends having a rectangular cross section in a manner to essentially eliminate the voids and with their longitudinal axes and the longitudinal axis of the tube essentially parallel. Ends of the tube are sealed and the sealed unit is reduced in cross section and elongated by hot rolling. The other materials are removed from the resulting filaments of the first metal yielding materials suitable for weaving into metal cloth.

U.S. Pat. No. 3,785,036 discloses a method of producing fine metallic filaments by covering a bundle of a plurality of metallic wires with an outer tube metal and drawing the resultant composite wire, wherein the outer tube metal on both sides of the final composite wire obtained after the drawing step is cut near to the core filaments present inside the outer tube and then both uncut surfaces of the composite wire are slightly rolled thereby to divide the outer tube metal of the composite wire continuously and thus separating the outer tube metal from fine metallic filaments. The separation treatment can be effected by a simple apparatus within a short time. This reduces the cost of production, and enables the outer tube metal to be recovered in situ.

U.S. Pat. No. 3,807,026 discloses a method of producing a yarn of fine metallic filaments at low cost, which comprises covering a bundle of a plurality of metal wires with an outer tube metal to form a composite wire, drawing the composite wire and then separating the outer tube metal from the core filaments in the composite wire, wherein for ease of the separation treatment, the surfaces of the metal wires are coated with a suitable separator or subjected to a suitable surface treatment before the covering of the outer tube metal, thereby to prevent the metallic bonding of the core filaments to each other in the subsequent drawing or heat-treatment of the composite wire.

U.S. Pat. No. 4,044,447 discloses a number of wires gathered together and bound with an armoring material in the shape of a band. The wires in this condition are drawn by means of a wire drawing apparatus having dies and a capstan. A plurality of bundles of such wires are gathered together and bound in the same way as in the foregoing to form a composite bundle body, which is further drawn, and these processes are repeated until at least filaments of a specific diameter are obtained in quantities.

U.S. Pat. No. 4,065,046 discloses a collimated hole structure formed by constricting a plurality of tubular elements each provided with a core for supporting the tubular element during the constricting operation. The bundle of elements is constricted to a point where the elements effectively fuse into a substantially monolithic body. The cores are then removed, leaving a plurality of extremely small diameter, generally parallel passages in a solid body. The tubular elements may be arranged in any desired array, and thus the passages may be provided similarly in any desired array. The passages may have high aspect ratios and may be closely juxtaposed. In one illustrative application, the collimated hole structure is provided with dielectric film and utilized as an anode portion of an electrolytic capacitor. In another illustrative application, the collimated hole structure is utilized as a tip for a drilling device.

U.S. Pat. No. 4,118,845 discloses a method of forming a tow of filaments and the tow formed by the method wherein a bundle of elongated elements such as rods or wires, is clad by forming a sheath of material different from that of the elements about the bundle and the bundle is subsequently drawn to constrict the elements to a desired small diameter. The elements may be formed of metal. The bundle may be annealed, or stress relieved, between drawing steps as desired. The sheath may be forined of metal and may have juxtaposed edges thereof welded together to retain the assembly. The sheath is removed from the final constricted bundle to free the filaments in the form of tow.

U.S. Pat. No. RE 28,526 to Ziemek discloses a copper band formed around an aluminum core wire and the single seam in the sheath material is welded without bonding of the sheath and core, care being taken that all surfaces are clean and maintained free of oxides. The copper tube is reduced to the diameter of the aluminum core. This composite wire is then passed through a plurality of drawing dies which reduce the diameter of the wire, preferably at least 50 percent, care being taken to prevent the copper sheath from tearing. The drawing operation produces, depending on the reduction rate, an initial or a complete bond between the core and sheath. Subsequently, the clad wire is either subjected to a limited diffusion heat treatment, conditions of the heat treatment being controlled to produce a complete and flawless bond between the sheath and core but, at the same time, avoiding the formation of an $CuAl_2$, a phase which is brittle or is annealed to get the required grade. Generally, the diffusion layer on either side of the sheath-core interface is limited to about 10 $\mu$.

U.S. Pat. No. 3,277,564 to Webber et al teaches a method of forming a tow of substantially bare filaments comprising the steps of sheathing each of a plurality of elongated drawable metal elements from which the filaments are to be formed with a tubular sheath formed of a material having characteristics permitting the sheaths to be pressed together to form a substantially monolithic body and differing chemically substantially from those of the elements to permit separation of the sheath material from elements when desired. The sheathed elements are bundled in substantially parallel relationship. The bundled sheathed elements are mechanically worked in at least one working step to reduce the cross-section of the elements to a preselected filament cross-section of less than approximately 10 microns maximum transverse dimension and to cause the sheath material to form a matrix extending substantially continuously in cross-section thereby to preclude separation of individual sheathed filaments. The sheathing material is completely removed while maintaining the filaments in bundled relationship to provide a tow of substantially bare separate filaments.

U.S. Pat. No. 3,375,569 to Eichinger et al teaches a method of making porous structures comprising the steps of winding a first row of wire on a winding support, the row having a large number of wire turns therein and having a predetermined pitch, winding subsequent rows of wire on the first row with each subsequent row having the same pitch as the first row so that each of the wire turns contacts substantially all of the immediately adjacent ones of the wire turns, bonding each of the turns to substantially all of its adjacent turns, and cutting sections from the turns generally transversely of the winding direction, the sections corresponding in thickness to the desired thickness of the porous structures.

U.S. Pat. No. 3,894,675 to Klebl et al discloses a copper clad steel wire being continuously produced by forming a copper sheet into a tube around the wire and welding the copper tube, at the edges, to produce a longitudinal seam. The diameter of the welded copper tube is reduced to the diameter of the wire, and the composite heated to a temperature of at least 850° C., at which temperature the cross sectional area of the composite wire is reduced by at least 10 percent to bond the copper to the steel wire.

U.S. Pat. No. 3,945,555 to Schmidt discloses a manufacturing process for a solid or hollow shaft consisting of aluminum or titanium with beryllium reinforcing therein. Beryllium rods are either clad with aluminum or titanium or, in the alternative, holes are drilled in an aluminum or titanium block which beryllium material is thereafter inserted into the holes. The perform with a hard steel central mandrel around which the beryllium rods are positioned is placed within a steel can and heated to a predetermined temperature. Pressure is then uniformly applied to the outer circumference of the can to ensure uniform deformation of the beryllium reinforcement. The uniform exterior pressure on the outer surfaces of the beryllium rods and the interior pressure on these rods caused by the hard steel mandrel against the under surfaces of the rods as a result of a reduction process causes the beryllium rods to assume an arcuate ribbon configuration. For hollow shafting, the mandrel at tie center of the perform may later be removed.

U.S. Pat. No. 4,109,870 and U.S. Pat. No. 4,166,564 to Wolber discloses a multiorifice structure and a method of making the multiorifice structure. The structure is made by fusing a plurality of parallel rods stacked in a regular geometric pattern. The interstices between the fused rods form a plurality of small orifices of a noncircular configuration which are ideally suited for atomizing a pressurized fluid. In the preferred embodiment, the multiorifice structure is a fuel atomizer for atomizing the fuel ejected from an automotive type fuel injection valve.

U.S. Pat. No. 4,156,500 to Yoshida et al teaches a method of producing a copper clad steel wire comprising the steps of preparing a 5 to 15 mm diameter steel rod and a 21 to 66.7 mm width copper tape; continuously supplying the steel rod and the copper tape separately and cleaning the surfaces thereof; forming the copper tape in tubular form such that the copper tape can cover the steel rod while supplying the steel rod and the copper tape in parallel, and welding the edges of the copper tape in a non-oxidizing atmosphere; sinking the tubular copper tape sufficiently for the copper tape to substantially come into contact with the steel rod to form a copper clad steel rod; cold-drawing the copper clad steel rod and/or hot working the clad rod at a temperature of 400° to 800° C. to reduce its cross-sectional area by more than 20%; and then annealing the copper clad steel rod at a temperature of 300° to 1050° C.

Although the aforementioned processes have provided high quality metallic fibers in the desired diameter range, the aforementioned processes still suffer from certain deficiencies. Firstly, the process of multiple claddings in one example incorporates the use of carbon steel cladding of stainless steel fibers. Unfortunately, the removal of carbon steel cladding material from stainless steel wire or fibers is a costly, time consuming and an environmentally unfriendly process. This is especially true when a three clad process is incorporated into the process of making fine metallic fibers.

Another disadvantage of the aforementioned process when making stainless steel fibers through the use of a carbon steel cladding is the involved chemical process for removing the carbon steel cladding from the stainless steel fibers. A further disadvantage of the prior art process is the amount of unusable byproducts from the carbon steel removed from the stainless steel to produce the fine metallic fibers.

Accordingly, it is an object of the present invention to provide an improved process for making fine metallic fibers which overcomes the disadvantages of the prior art and produces fine metallic fibers in an economic and efficient manner.

Another object of this invention is to provide an improved process for making fine metallic fibers incorporating only a single cladding process of either a formed or preformed type.

Another object of this invention is to provide an improved process for making fine metallic fibers wherein the cladding of the formed or preformed type and is only in use partially through the drawing process.

Another object of this invention is to provide an improved process for making fine metallic fibers incorporating only a single continuous cladding process.

Another object of this invention is to provide an improved process for making fine metallic fibers wherein the cladding is only in use partially through the drawing process.

Another object of this invention is to provide an improved process for making fine metallic fibers wherein the cladding of the formed or preformed type is mechanically removed without the need for a chemical leaching process.

Another object of this invention is to provide an improved process for making fine metallic fibers with only a two step drawing and annealing process.

Another object of this invention is to provide an improved process for making fine metallic fibers incorporating a metallic copper coating and a carbon steel cladding wherein the copper coating inhibits the diffusion of undesirable impurities from the carbon steel cladding into the metallic fibers.

Another object of this invention is to provide an improved process for making fine metallic fibers wherein the metallic fibers can be produced with a simple chemical leaching process or electrolysis process whereby the material removed is totally reusable within the process.

Another object of this invention is to provide an improved process for making fine metallic fibers whereby the leaching or electrolysis process is simple and efficient, fast and economical to operate.

Another object of this invention is to provide an improved process for making fine metallic fibers whereby fibers of less than one micrometer can be obtained in commercial quantities.

Another object of this invention is to provide an improved process for making fine metallic fibers that provides high quality metallic fibers of low impurities at an economical manufacturing cost.

Another object of this invention is to provide an improved process for making fine metallic fibers that incorporates a process that produces only products that may be reusable byproducts or environmentally safe disposable byproducts.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a process for making fine metallic fibers comprising coating a plurality of metallic wires with a coating material. The plurality of metallic wires are jacketed with tube for providing a cladding. The cladding is drawn for reducing the outer diameter thereof. The tube is removed to provide a remainder comprising the coating material with the plurality of metallic wires contained therein. The remainder is drawn for reducing the diameter thereof and for reducing the corresponding diameter of the plurality of metallic wires contained therein. The coating material is removed for providing the plurality of fine metallic fibers.

In a more specific embodiment of the invention, the step of coating the plurality of metallic wires with a coating material includes electroplating the coating material onto the plurality of metallic wires. The step of coating a plurality of metallic wires with a coating material may include providing a mixture of first and second coated metallic wires with the first coated metallic wires having a smaller diameter than the second coated metallic wires.

In one embodiment of the invention, the process includes the step of forming the plurality of metallic wires into a plurality of arrays of metallic wires. Each of the plurality of arrays of metallic wires is bound with a wrapping material for providing a plurality of bound arrays. The plurality of bound arrays are jacketed with the tube for providing the cladding.

In another embodiment of the invention, the process includes encasing the plurality of coated metallic wires with a casing material for providing a casing. The casing is jacketed with the tube for providing the cladding.

The tube jacketing the plurality of metallic wires may be a preformed tube wherein the plurality of metallic wires are simultaneously inserted into a preformed tube. In the alternative, a longitudinally extending sheet of cladding material may be formed into a tube about the plurality of metallic wires.

The process of drawing the cladding diffusion welds the coating material within the cladding to form a substantially unitary coating material with the plurality of metallic wires contained therein. After drawing, tube may be mechanically removed by suitable means such as cutting the tube and peeling the tube from the remainder.

The process of removing the coating material may include chemically removing the coating material by immersing the remainder into an acid for dissolving the coating material for providing the plurality of fine metallic fibers.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated that the conception and the specific embodiments disclosed may be readily utilized as a basis for modifying or designing other structures for carrying out the same purposes of the present invention. It also should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
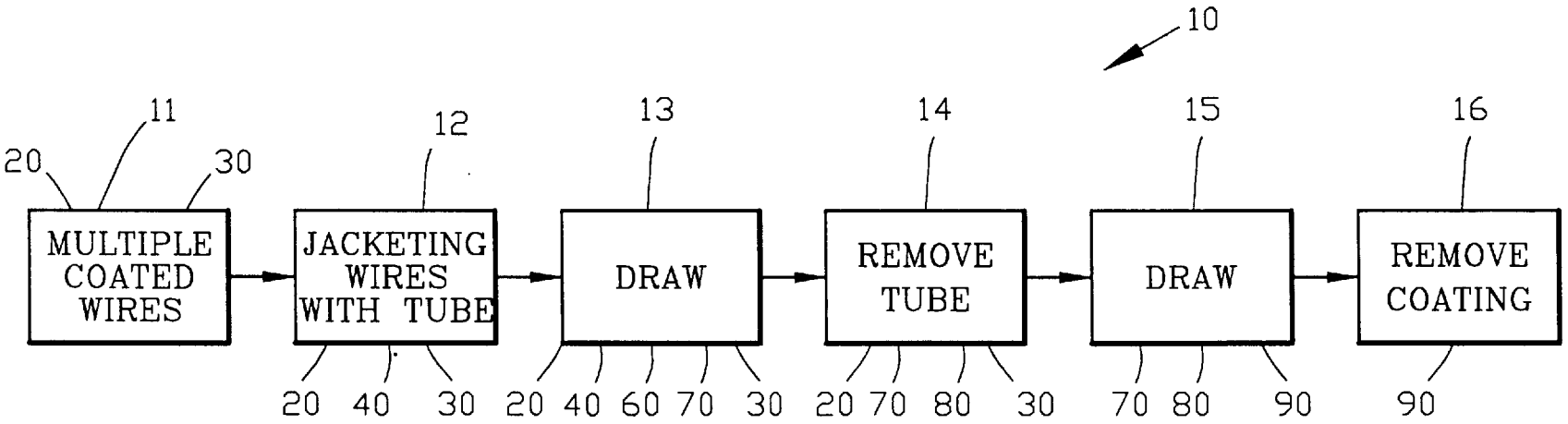
FIG. 1 is a block diagram illustrating an improved process of forming fine metallic fibers through a new cladding and drawing process of the present invention.

FIG. 1 is a block diagram illustrating an improved process 10 for making fine metallic fibers. The improved process 10 of FIG. 1 comprises the process step 11 of providing multiple coated metallic wires 20 with each of the metallic wires 20 having a coating material 30.

Figure 2:
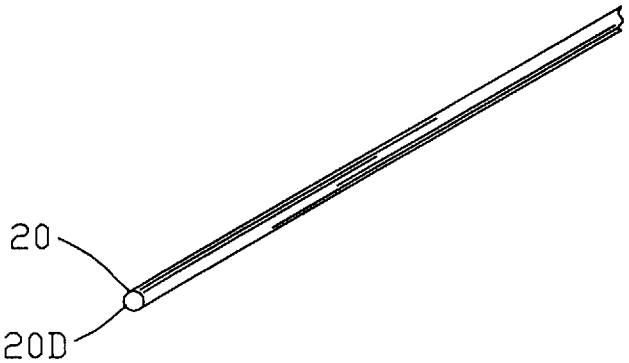
FIG. 2 is an isometric view of a metallic wire referred to in FIG. 1.
Figure 2A:
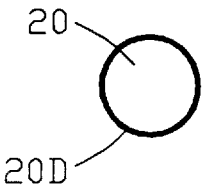
FIG. 2A is an enlarged end view of FIG. 2.

FIG. 2 is an isometric view of the metallic wire 20 referred to in FIG. 1 with FIG. 2A being an enlarged end view of FIG. 2. Preferably, the metallic wire 20 is a stainless steel wire having a diameter 20D.

Figure 3:
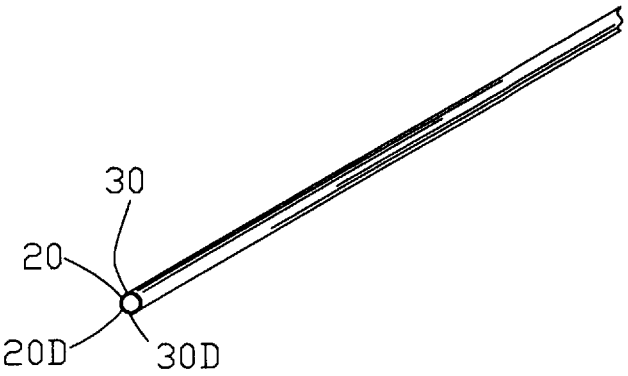
FIG. 3 is an isometric view of the wire of FIG. 2 with a coating material thereon.
Figure 3A:
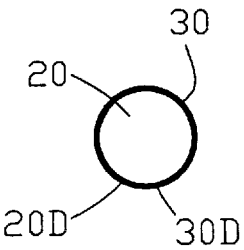
FIG. 3A is an enlarged end view of FIG. 3.

FIG. 3 is an isometric view of the metallic wire 20 of FIG. 2 with the coating material 30 thereon. FIG. 3A is an enlarged end view of FIG. 3. Preferably, the coating material 30 is a copper material. Although the process of applying the coating material 30 to the metallic wire 20 may be accomplished in various ways, the preferred coating process 11 of applying the coating material 30 to the metallic wire 20 is an electroplating process. The coating material 30 defines a coating diameter 30D. Preferably, the coating material 30 represents approximately five percent (5%) by weight of the combined weight of the metallic wire 20 and the coating material 30.

FIG. 1 illustrates the process step 12 of jacketing a plurality of coated metallic wires 20 with a tube 40.

Figure 4:
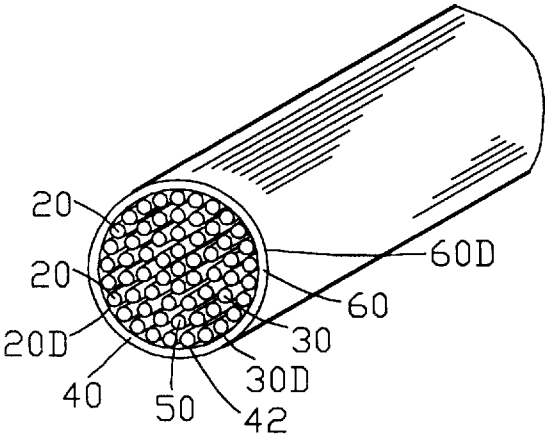
FIG. 4 is an isometric view of a plurality of the wires of FIG. 3 inserted within a preformed tube.
Figure 4A:
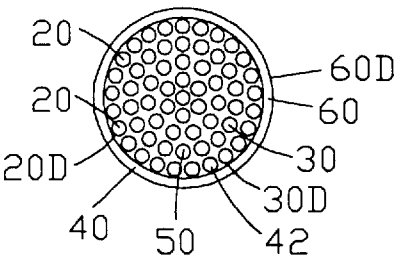
FIG. 4A is an end view of FIG. 4.

FIG. 4 is an isometric view of the plurality of the wires 20 jacketed or inserted within the preformed tube 40 with FIG. 4A being an end view of FIG. 4. FIG. 4A is an end view of FIG. 4. In this embodiment of the invention, the tube 40 is a preformed tube 40. The preformed tube 40 is straightened and cut into lengths of two hundred feet to four hundred feet. The interior of the preformed tube 40 is treated with a release material 42 to inhibit chemical interaction between the preformed tube 40 and a plurality of metallic wires 20 to be jacketed with the tube 40. Preferably, the preformed tube 40 is made of a carbon steel material. The release material 42 may be titanium dioxide $TiO_2$, sodium silicate, aluminum oxide, talc or any other suitable material to inhibit chemical interaction between the preformed tube 40 and a plurality of metallic wires 20. The release material 42 may be suspended within a liquid for enabling the release material 42 to be applied to the interior of the preformed tube 40.

The plurality of metallic wires 20 with the coating material 30 are assembled in an array 50. The array 50 of the plurality of metallic wires 20 with the coating material 30 thereon are jacketed within the tube 40 for providing a cladding 60 having a diameter 60D.

In this embodiment, the step 12 of jacketing the array 50 of the plurality of metallic wires 20 within the tube 40 includes simultaneously inserting the array 50 of the plurality of coated metallic wires 20 into the preformed metallic tube 40 to form a cladding 60. The cladding 60 defines an outer diameter 60D. Although the metallic tube 40 is disclosed as a preformed carbon steel tube, the array 50 of the plurality of metallic wires 20 may be encased within the tube 40 through a conventional cladding process. Preferably, approximately one thousand (1000) metallic wires 20 are inserted within the tube 40.

FIG. 1 illustrates the process step 13 of drawing the cladding 60. The process step 13 of drawing the cladding 60 provides three effects. Firstly, the process step 13 reduces an outer diameter 60D of the cladding 60. Secondly, the process step 13 reduces the corresponding outer diameter 20D of each of the plurality of metallic wires 20 and the corresponding outer diameter 30D of each of the coating materials 30. Thirdly, the process step 13 causes the coating materials 30 on each of metallic wires 20 to diffusion weld with the coating materials 30 on adjacent metallic wires 20.

The release material 42 is deposited on the interior of the preformed tube 40 in a quantity sufficient to inhibit the chemical interaction or bonding between the preformed tube 40 and a plurality of metallic wires 20 to be inserted within the tube 40. However, the release material 42 is deposited on the interior of the preformed tube 40 in a quantity insufficient to inhibit the diffusion weld of the coating materials 30 on adjacent metallic wires 20.

Figure 5:
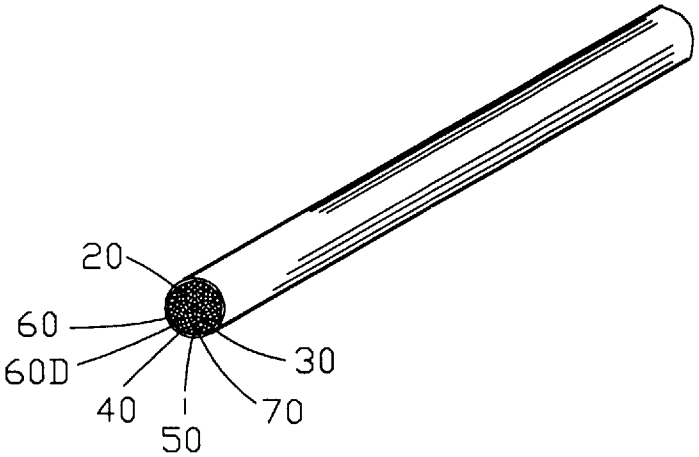
FIG. 5 is an isometric view of the plurality of the wires inserted within the preformed tube after drawing of the preformed tube.
Figure 5A:
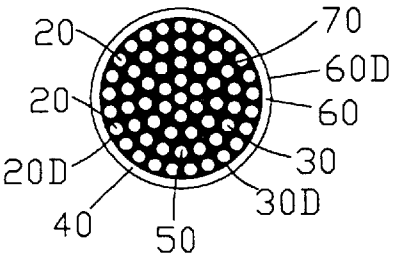
FIG. 5A is an enlarged end view of FIG. 5.

FIG. 5 is an isometric view of the plurality of the wires 20 inserted within the preformed tube 40 after the process step 13 of drawing the cladding 60. FIG. 5A is an enlarged end view of FIG. 5. The drawing of the cladding 60 causes the coating materials 30 on each of metallic wires 20 to diffusion weld with the coating materials 30 on adjacent metallic wires 20. The diffusion welding of the coating materials 30 on adjacent metallic wires 20 forms a unitary material 70. After the diffusion welding of the coating materials 30, the coating materials 30 is formed into a substantially unitary material 70 extending throughout the interior of the cladding 60. The plurality of metallic wires 20 are contained within the unitary material 70 extending throughout the interior of the cladding 60. Preferably, the coating material 30 is a copper material and is diffusion welded within the cladding 60 to form a substantially unitary copper material 70 with the plurality of stainless steel wires 20 contained therein.

FIG. 1 illustrates the process step 14 of removing the tube 40. In the preferred form of the process, the step 14 of removing the tube 40 comprises mechanically removing the tube 40.

Figure 6:
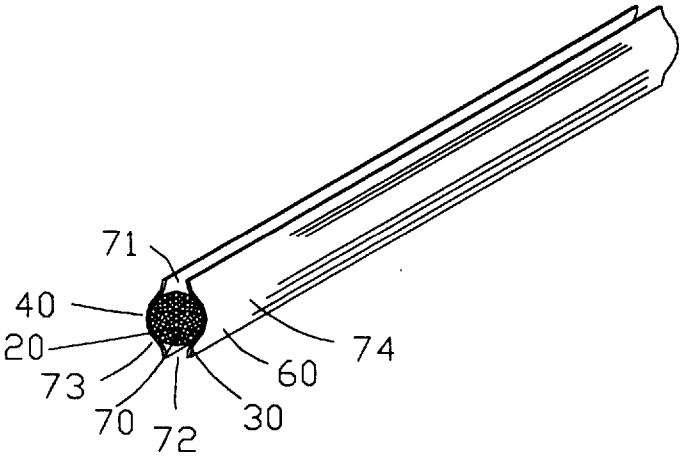
FIG. 6 is an isometric view illustrating the mechanical removal of the preformed tube after the first drawing process of FIG. 1.
Figure 6A:
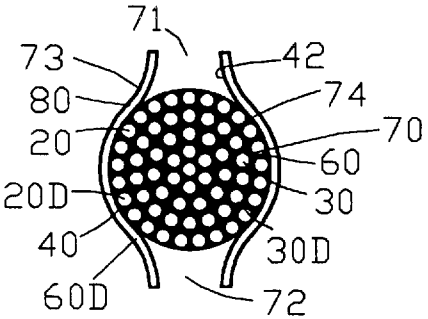
FIG. 6A is an enlarged end view of FIG. 6.

FIG. 6 is an isometric view illustrating the mechanical removal of the preformed tube 40 with FIG. 6A being an enlarged end view of FIG. 6. In one example of this process step 14, the tube 40 is scored or cut at 71 and 72 by mechanical scorers or cutters (not shown). The scores or cuts at 71 and 72 form tube portions 73 and 74 that are mechanically pulled apart to peel the cube 40 off of a remainder 80.

Figure 7:
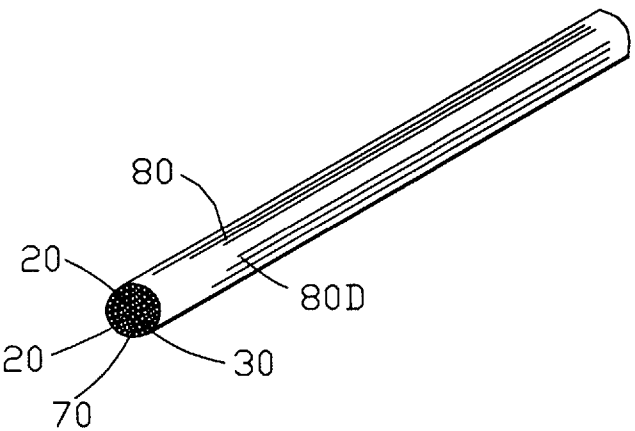
FIG. 7 is an isometric view illustrating the plurality of the wires after complete removal of the preformed tube.
Figure 7A:
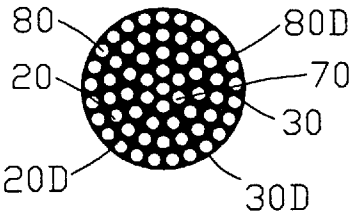
FIG. 7A is an enlarged end view of FIG. 7.

FIG. 7 is an isometric view illustrating the plurality of the wires 20 disposed within the remainder 80 after complete removal of the tube 40. FIG. 7A is an enlarged end view of FIG. 7. The remainder 80 comprises the substantially unitary coating material 70 with the plurality of metallic wires 20 contained therein. The remainder 80 defines an outer diameter 80D.

FIG. 1 illustrates the process step 15 of drawing the remainder 80 for reducing the outer diameter 80D thereof and for reducing the corresponding outer diameter 20D of the plurality of metallic wires 20 contained therein.

Figure 8:
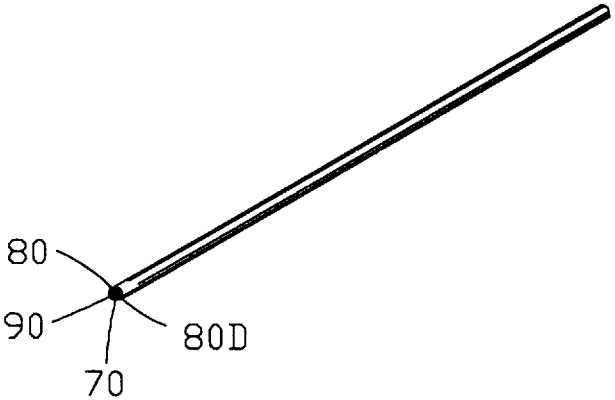
FIG. 8 is an isometric view of the plurality of the wire of FIG. 7 reduced into a plurality of fine metallic fibers by a second drawing process.
Figure 8A:
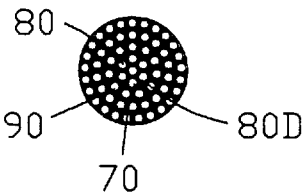
FIG. 8A is an enlarged end view of FIG. 8.

FIG. 8 is an isometric view of the plurality of wires 20 of FIG. 7 reduced into a plurality of fine metallic fibers 90 by the process step 15 of drawing the remainder 80. FIG. 8A is an enlarged end view of FIG. 8. The substantially unitary material 70 provides mechanical strength for the plurality of metallic wires 20 contained therein for enabling the remainder 80 to be drawn without the cladding 60. The substantially unitary coating material 70 enables the remainder 80 to be drawn for reducing the outer diameter 80D thereof and for providing the plurality of fine metallic fibers 90.

Figure 9:
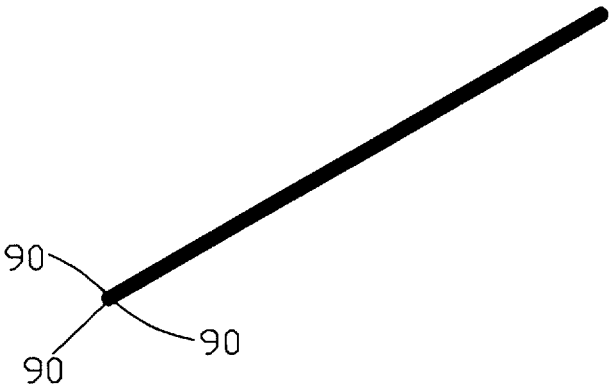
FIG. 9 is an isometric view of the plurality of the fine metallic fibers of FIG. 8 after chemical removal of the coating material.
Figure 9A:
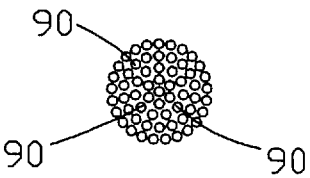
FIG. 9A is an enlarged end view of FIG. 9.

FIG. 9 is an isometric view of the plurality of the fine metallic fibers 90 of FIG. 8 after the process step 16 of FIG. 1 of removing the unitary material 70. FIG. 9A is an enlarged end view of FIG. 9. Preferably, the unitary material 70 is removed by an acid leaching process for dissolving the unitary copper material 70 to provide a plurality of stainless steel fibers 90.

One example of the process step 16 includes an acid leaching process. The remainder 80 comprising the substantially unitary copper material 30 with the plurality of stainless steel wires 20 is immersed into a solution of 8% to 15% $H_2SO_4$ and 0.1% to 1.0% $H_2O_2$ for dissolving the unitary copper material 70 without dissolving the stainless steel fibers 90. The 0.1% to 1.0% $H_2O_2$ functions as an oxidizing agent to inhibit leaching of stainless steel fibers 90 by the $H_2SO_4$.

Preferably, the 0.5% to 3.0% $H_2O_2$ is stabilized from decaying in the presence of copper such as PC circuit board grade $H_2O_2$. It should be appreciated that other oxidizing agents may be used with the present process such as sodium benzoate or sodium benzoate or the like.

The above acid leaching process 16 is governed by the reaction illustrated in equation $$Cu+H_2O_2+H_2SO_4 \rightarrow CuSO_4+2H_2O$$

The initial concentration of the $H_2SO_4$ is 11.0% at a concentration of 20.0 grams per liter of Cu+2 as $CuSO_4$ at a temperature of 80° F. to 120° F. The concentration is maintained between 8.0% to 11.0% $H_2SO_4$ and 20.0 to 70.0 grams per liter of $Cu^{+2}$ as $CuSO_4$.

The $H_2O_2$ dissolves the unitary copper material 70 without dissolving the stainless steel fibers 90. After the unitary copper material 70 is dissolved, the stainless steel fibers 90 are passed to a rinsing process.

The removal process 16 includes rinsing the stainless steel fibers 90 in a rinse solution comprising $H_2O$ having a pH of 2.0 to 3.0 with the pH being adjusted with $H_2SO_4$. Maintaining the pH of the rinsing solution between a pH of 2.0 to 3.0 inhibits the formation of $Fe[OH]_2$. After rinsing the stainless steel fibers 90, the stainless steel fibers 90 may be used as cut stainless steel fibers 90 or as stainless steel fiber tow.

Figure 10:
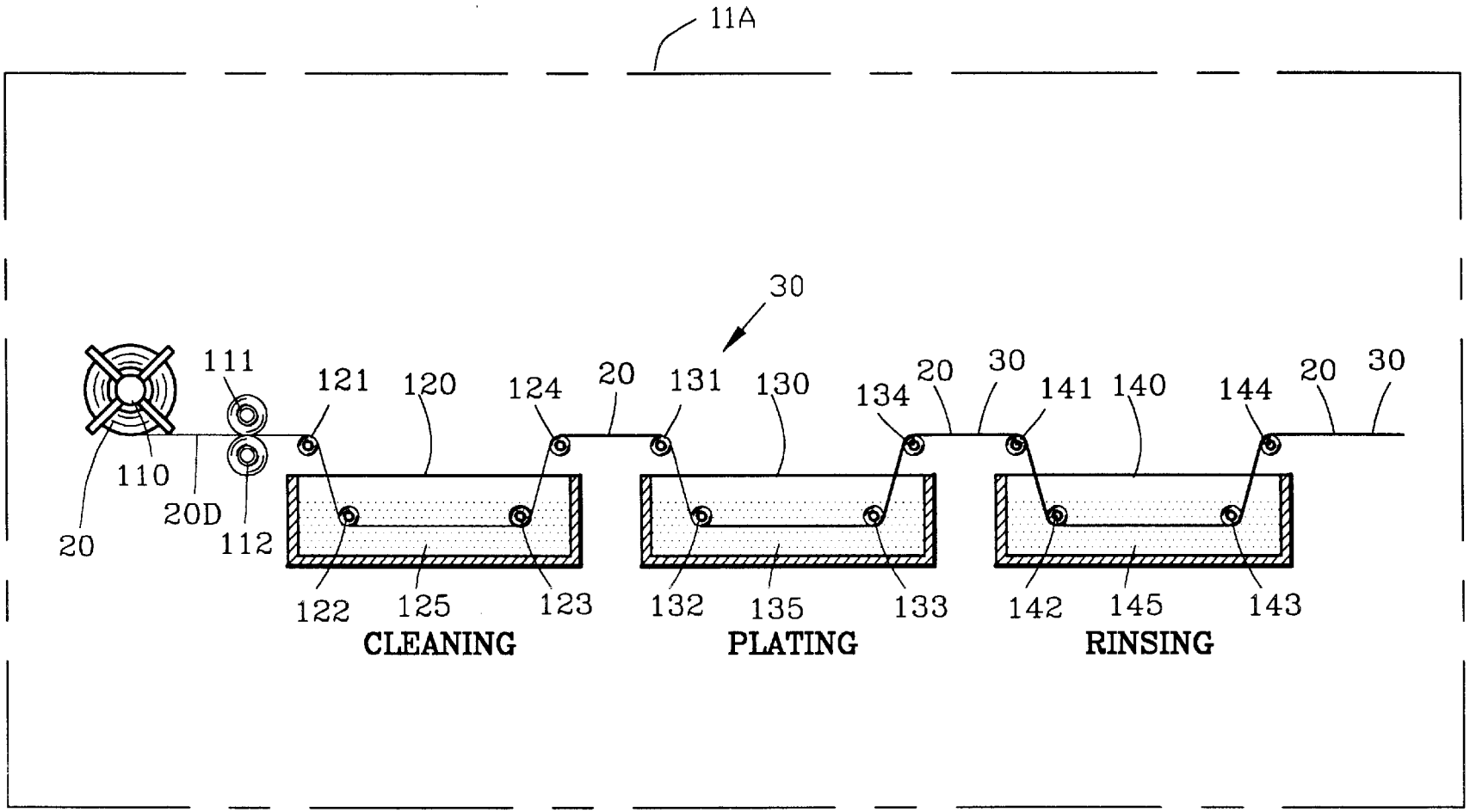
FIG. 10 is a diagram illustrating a specific process of coating a metallic wire shown as plating a copper coating onto a stainless steel wire.

FIG. 10 is a diagram illustrating one specific process step 11A of providing multiple coated metallic wire 20 having a coating material 30. In this example, the specific process step includes electroplating the copper material 30 onto the stainless steel wire 20. The stainless steel wire 20 is removed from a spool 110 by drive spools 111 and 112 and is directed by spools 121–124 to pass through a cleaning tank 120 having a cleaning solution 125. The cleaning tank 120 removes any oxides or other contaminants from the outer diameter 20D of the stainless steel wire 20. The cleaned stainless steel wire 20 is directed by spools 131–134 to pass through a plating tank 130 having a plating solution 135. The plating tank 130 electro-plates the copper material 30 onto the outer diameter 20D of the stainless steel wire 20. The coated stainless steel wire 20 is directed by spools 141–144 to pass through a rinsing tank 140 having a rinsing agent 145 for removing any residue remaining from the plating tank 130.

Figure 11:
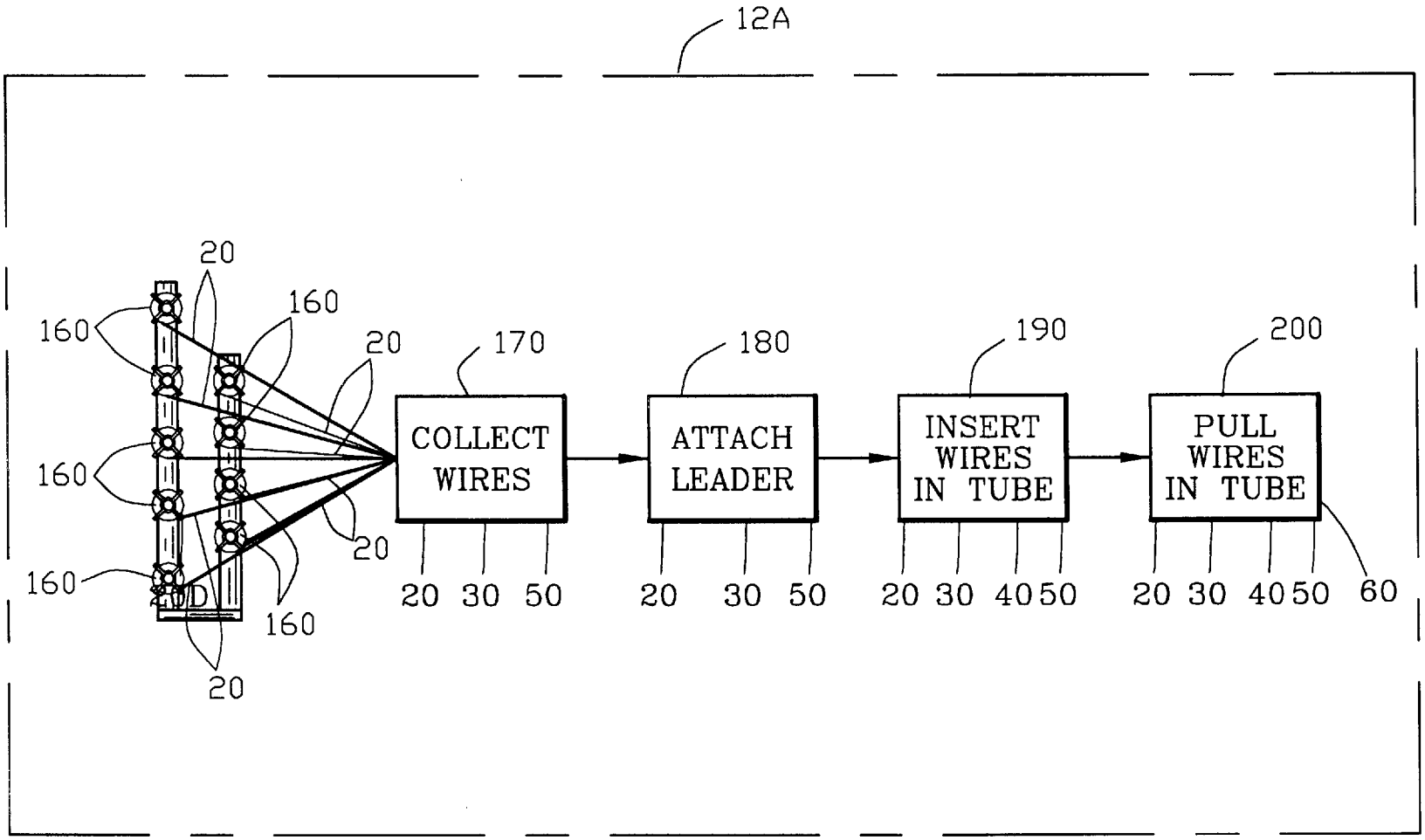
FIG. 11 is a diagram of a first process of jacketing a plurality of the coated wires of FIG. 1 within a preformed tube for providing the cladding.

FIG. 11 is a diagram of a specific process step 12A of jacketing a plurality of metallic wires 20 with the coating material 30 with a tube 40. A plurality of spools 160 contain the plurality of metallic wires 20 with the coating material 30. The plurality of metallic wires 20 with the coating material 30 are collected into the array 50 in the process step 170. The process step 180 illustrates attaching the array 50 of the plurality of metallic wires 20 to a leader (not shown). The leader (not shown) is inserted within the tube 40 in the process step 190. The leader (not shown) is pulled through the tube 40 in the process step 200 for pulling of the array 50 of the plurality of metallic wires 20 with the coating material 30 through the tube 40 for providing the first cladding 60.

Figure 12:
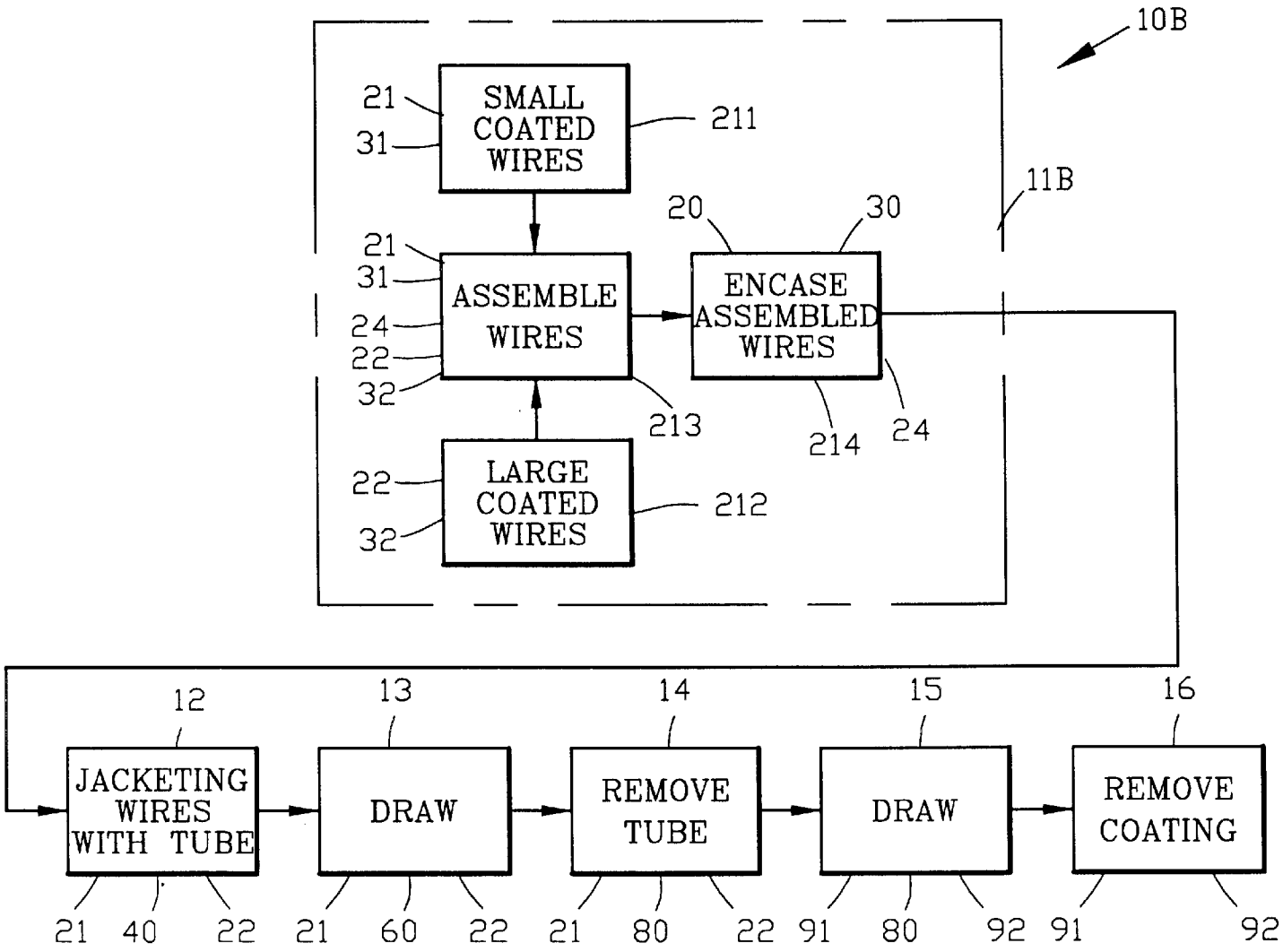
FIG. 12 is a block diagram illustrating a variation of the improved process of forming fine metallic fibers of the present invention.

FIG. 12 is a block diagram illustrating a second improved process 10B for making fine metallic fibers that is a variation of the process 10 illustrated in FIG. 1. The improved process 10B sets forth a variation 11B of the process step 11 of FIG. 1. In this example, the process step 11B includes the step 211 of providing a first metallic wire 21 and the step 212 of providing a second metallic wire 22. The process step 11B includes the step 213 of assembling the first and second metallic wires 21 and 22 to form an assembly 24. The first metallic wire 21 may differ from the second metallic wire 22 in either size, composition, physical property or any combination thereof.

Figure 13:
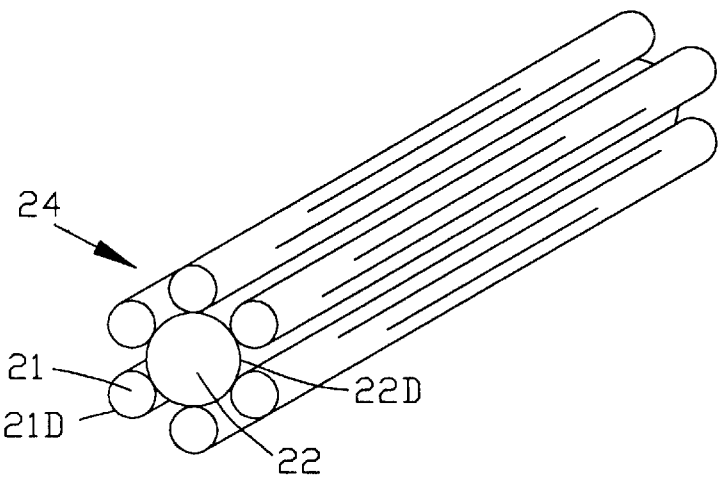
FIG. 13 is an isometric view of an array of mixed small and large wires.
Figure 13A:
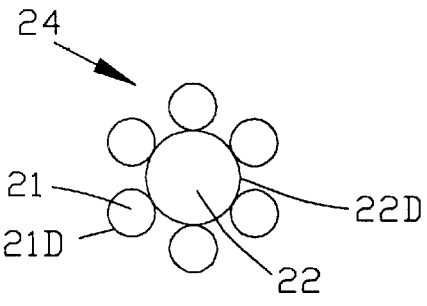
FIG. 13A is an enlarged end view of FIG. 13.

FIG. 13 is an isometric view of the first and second metallic wires 21 and 22 assembled in the assembly 24. FIG. 13A is an end view of FIG. 13. The assembly 24 comprises a mixture of the first and second metallic wires 21 and 22. In the example, each of the plurality of first metallic wires 21 has first diameter 21D whereas the second metallic wire 22 has second diameter 22D. The first diameter 21D of the first metallic wire 21 is smaller in diameter relative to the second diameter 22D of the second metallic wire 22. As will be described in greater detail hereinafter, the assembly 24 may be formed in various ways.

Figure 14:
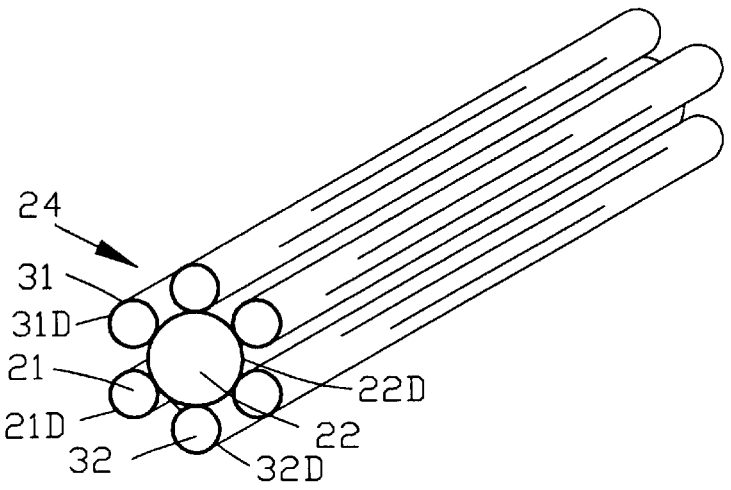
FIG. 14 is an isometric view of the array of FIG. 13 with a coating applied to the small and large wires.
Figure 14A:
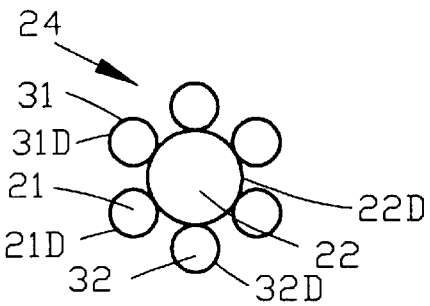
FIG. 14A is an enlarged end view of FIG. 14.

FIG. 14 is an isometric view of the assembly 24 of the first and second plurality of coated wires 21 and 22 of FIG. 14 with the coating materials 31 and 32 thereon. FIG. 14A is an end view of FIG. 14. Preferably, the first and second metallic wires 21 and 22 are a stainless steel wire with the coating materials 31 and 32 being a copper material. In the alternative, one of the first and second metallic wires 21 and 22 may have similar composition and/or physical property as the coating materials 31 and 32.

The first and second coating materials 31 and 32 define a first and a second coating diameter 31D and 32D. Although the process of applying the coating material 31 and 32 to the metallic wires 21 and 22 may be accomplished in various ways, the preferred coating process of applying the coating material 31 and 32 to the metallic wire 21 and 22 is the electroplating process described in FIG. 10.

FIG. 12 illustrates the process step 214 of encasing an array 50A of the assemblies 24 of the first and second plurality of coated wires 21 and 22.

Figure 15:
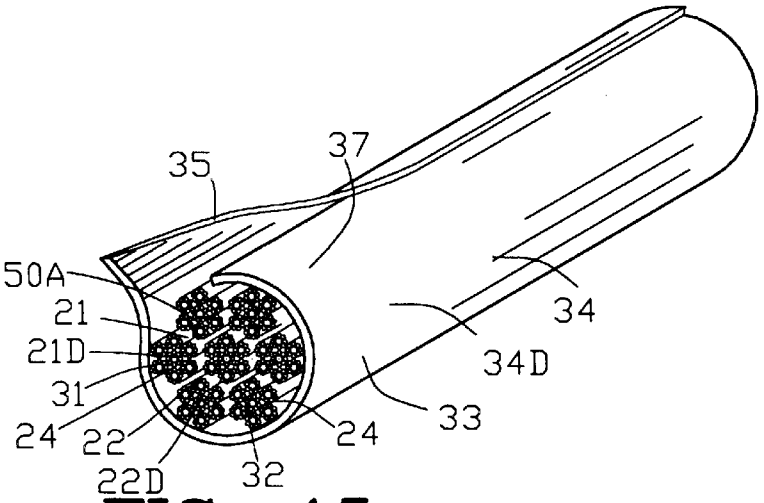
FIG. 15 is an isometric view of an initial process of encasing a plurality of arrays of FIG. 14 within a casing.
Figure 15A:
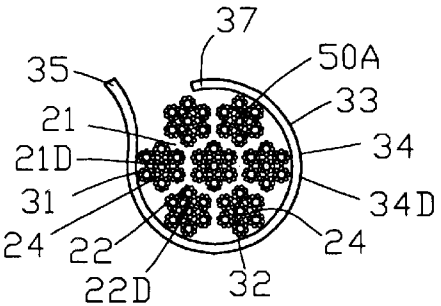
FIG. 15A is an end view of FIG. 15.

FIG. 15 illustrates an initial process of encasing the array 50A of assembly 24 with a casing material 33. FIG. 15A is an end view of FIG. 15. The array 50A of assemblies 24 of the first and second plurality of the wires 21 and 22 are encased within the casing material 33 for providing a casing 34 having a diameter 34D. Preferably, the casing material 33 is the same material as the coating material 31 and 32.

Figure 16:
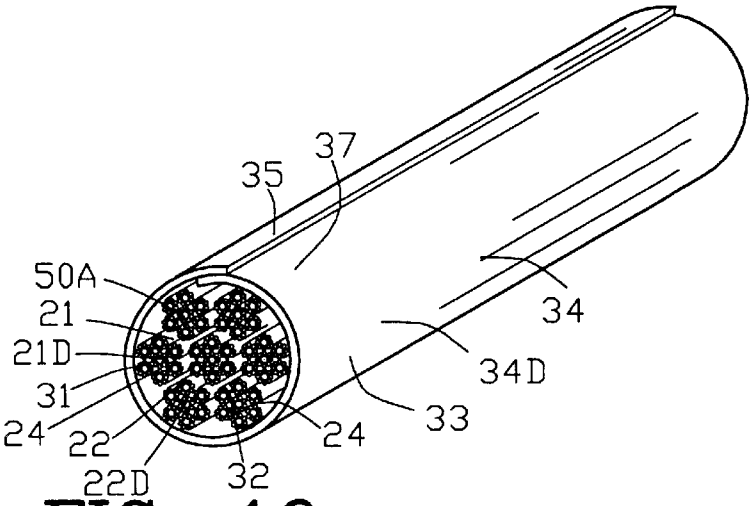
FIG. 16 is an isometric view of the completed process of encasing the plurality of arrays.
Figure 16A:
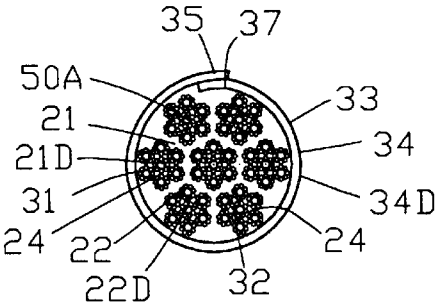
FIG. 16A is an end view of FIG. 16.

FIG. 16 illustrates the completed process of encasing the array 50A of assemblies 24 of the first and second plurality of the wires 21 and 22 within the casing material 33. FIG. 16A is an end view of FIG. 16. The step of encasing the array 50A of assemblies 24 within the casing material 33 includes bending a first and a second edge 35 and 37 of a longitudinally extending casing material 33 to form the casing 34 with the first edge 35 of the casing material 33 overlapping the second edge 37 of the casing material 30.

FIG. 12 illustrates the process step 12 of jacketing the casing 34 of the array 50A of assemblies 24 within the tube 40.

Figure 17:
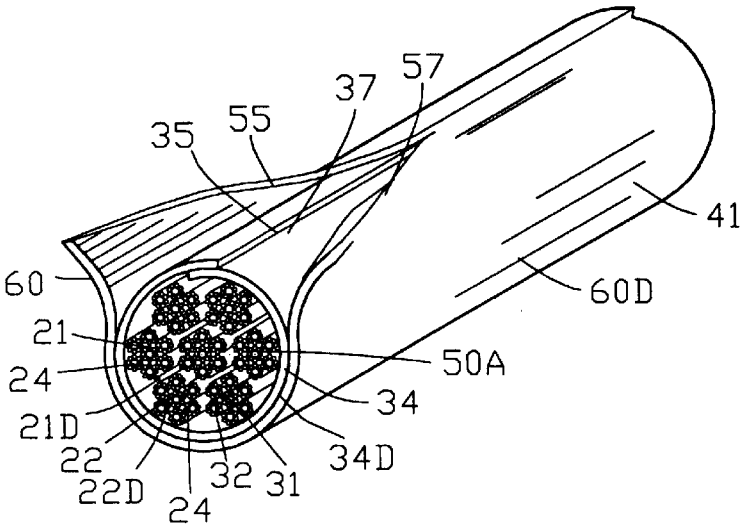
FIG. 17 is an isometric view of an initial process of jacketing the casing of FIG. 16 with a tube.
Figure 17A:
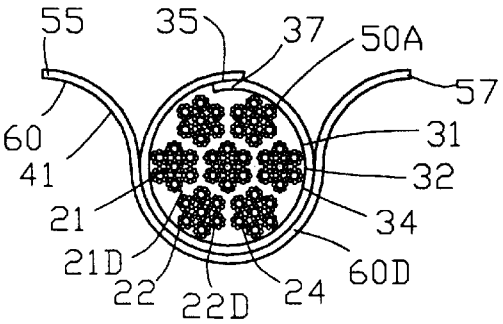
FIG. 17A is an end view of FIG. 17.

FIG. 17 is an isometric view illustrating an initial process of jacketing the casing 34 with the tube 40. FIG. 17A is an end view of FIG. 17. The step of jacketing the casing 34 with the tube 40 includes forming the tube 40 from a cladding material 41. A first and a second edge 55 and 57 of a longitudinally extending sheet of the cladding material 41 is bent to form a cladding 60 to enclose the casing 34. The cladding 60 defines an outer diameter 60D.

Figure 18:
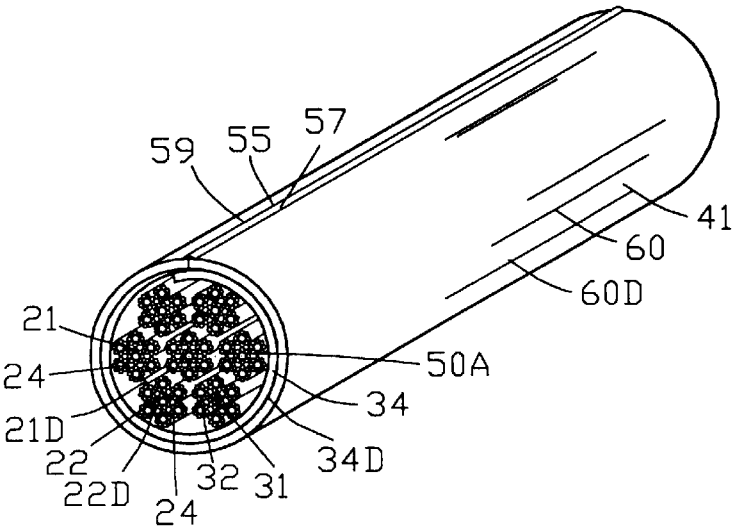
FIG. 18 is an isometric view of the completed process of jacketing the casing.
Figure 18A:
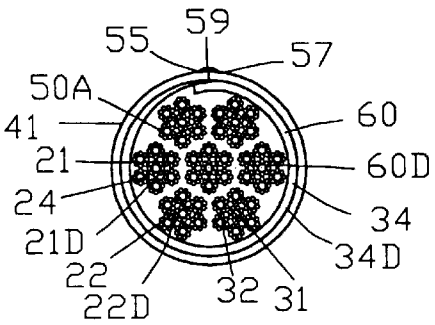
FIG. 18A is an end view of FIG. 18.

FIG. 18 is an isometric view of the completed process of jacketing the casing 34. FIG. 18A is an end view of FIG. 18. The longitudinally extending sheet of the cladding material 41 is bent with the first edge 55 of the cladding material 41 abutting the second edge 57 of the cladding material 41. The first edge 55 of the cladding material 41 is welded to the second edge 57 of the cladding material 41 by a weld 59.

The casing material 34 acts as a heat sink to facilitate the welding of the first edge 55 to he second edge 57 of the cladding material 41. Furthermore, the casing material 34 acts as a heat sink to protect the array 50A of assemblies 24 of the first and second plurality of coated wires 21 and 22 within the casing material 34 from the heat of the welding process.

Preferably, the cladding material 41 is a carbon steel material with the plurality of first and second metallic wires 21 and 22 being made of a stainless steel material. The coating material 31 and 32 and the casing material 33 are preferably a copper material. Preferably, approximately one thousand (1000) of the first and second metallic wires 21 and 22 are encased within the casing 34.

The interior of the cladding material 41 may be treated with a release material 42 to inhibit chemical interaction between the cladding material 41 and the first and second plurality of metallic wires 21 and 22 encased within the casing 34. The release material 42 may be any suitable material to inhibit chemical interaction between the cladding material 41 and a plurality of the first and second plurality of metallic wires 21 and 22.

FIG. 12 illustrates the process step 13 of drawing the cladding 60 for reducing the outer diameter 60D of the cladding 60.

Figure 19:
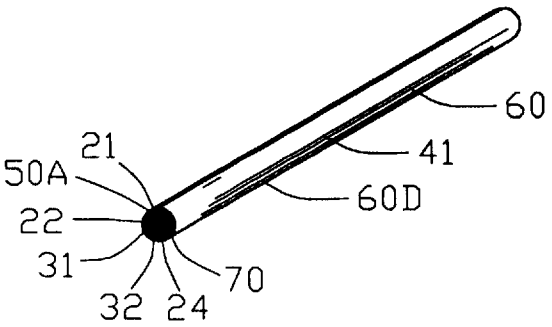
FIG. 19 is an isometric view of the cladding of FIG. 18 after a first drawing process.
Figure 19A:
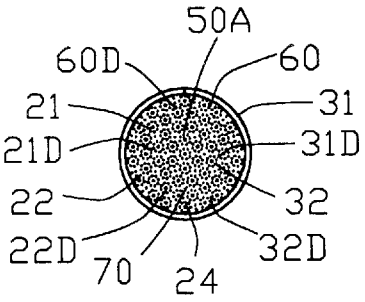
FIG. 19A is an enlarged end view of FIG. 19.

FIG. 19 is an isometric view of the cladding 60 of FIG. 18 after the first drawing process 13. FIG. 19A is an end view of FIG. 19. The process step 13 of drawing the cladding 60 provides four effects. Firstly, the process step 13 reduces the outer diameter 60D of the cladding 60. Secondly, the process step 13 reduces the corresponding outer diameter 21D and 22D of each of the first and second plurality of metallic wires 21 and 22 and the corresponding outer diameter 31D and 32D of each of the coating materials 31 and 32. Thirdly, the process step 13 causes the coating materials 31 and 32 on each of the first and second plurality of metallic wires 21 and 22 to diffusion weld with the coating materials 31 and 32 on adjacent metallic wires 21 and 22. Fourthly, the process step 13 causes the casing material 33 to diffusion weld with the coating materials 31 and 32 on the first and second plurality of metallic wires 21 and 22.

The drawing of the cladding 60 causes the coating materials 31 and 32 on each of the first and second plurality of metallic wires 21 and 22 to diffusion weld with the coating materials 31 and 32 on adjacent first and second plurality of metallic wires 21 and 22 and to diffusion weld with the casing material 33. The diffusion welding of the coating materials 31 and 32 and the casing material 33 forms a unitary material 70. After the diffusion welding of the coating materials 31 and 32 and the casing material 33, the coating materials 31 and 32 and the casing material 33 are formed into a substantially unitary material 70 extending throughout the interior of the cladding 60. The first and second plurality of metallic wires 21 and 22 are contained within the unitary material 70 extending throughout the interior of the cladding 60. Preferably, the coating material 31 and 32 and the casing material 33 is a copper material and is diffusion welded within the cladding 60 to form a substantially unitary copper material 70 with the first and second plurality of metallic wires 21 and 22 contained therein.

FIG. 12 illustrates the process step 14 of removing the tube 40. Preferably, the step 14 of removing the tube 40 comprises mechanically removing the tube 40.

Figure 20:
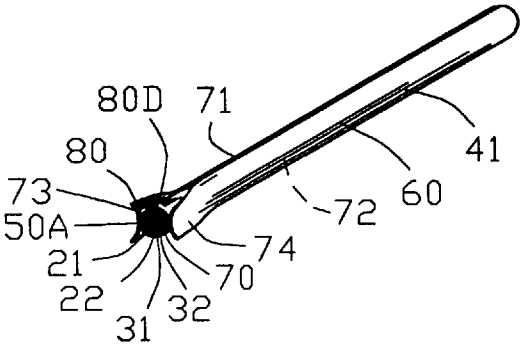
FIG. 20 is an isometric view illustrating the mechanical removal of the tube after the first drawing process of FIG. 19.
Figure 20A:
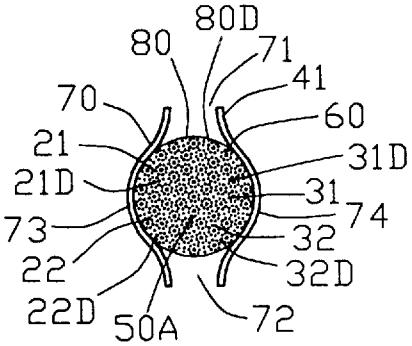
FIG. 20A is an enlarged end view of FIG. 20.

FIG. 20 is an isometric view illustrating the mechanical removal of the tube 40 with FIG. 20A being an enlarged end view of FIG. 20. In one example of this process step, the tube 40 is scored or cut at 71 and 72 by mechanical scorers or cutters (not shown). The scores or cuts at 71 and 72 form tube portions 73 and 74 that are mechanically pulled apart to peel the tube 40 off of a remainder 80. The remainder 80 comprises a substantially unitary material 70 with the first and second plurality of metallic wires 21 and 22 contained therein. The remainder 80 defines an outer diameter 80D.

FIG. 12 illustrates the process step 15 of drawing the remainder 80 for reducing the outer diameter 80D thereof and for reducing the corresponding outer diameter 21D and 22D of the first and second plurality of metallic wires 21 and 22 contained therein.

Figure 21:
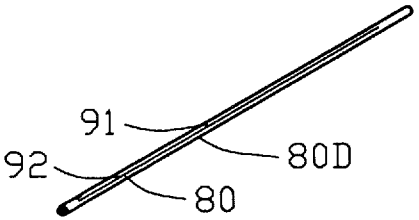
FIG. 21 is an isometric view of the casing of FIG. 20 after the second drawing process.
Figure 21A:
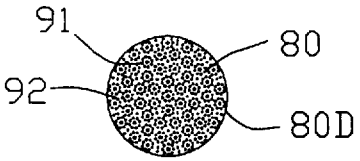
FIG. 21A is an enlarged end view of FIG. 21.

FIG. 21 is an isometric view of the remainder 80 after the drawing process step 15 of FIG. 12. FIG. 21 A is an enlarged end view of FIG. 21. The substantially unitary material 70 provides mechanical strength for the first and second plurality of metallic wires 21 and 22 contained therein for enabling the remainder 80 to be drawn without the cladding 60. The drawing process 15 reduces the diameter 21D and 22D of the first and second plurality of metallic wires 21 and 22 into a first and a second plurality of fine metallic fibers 91 and 92.

Figure 22:
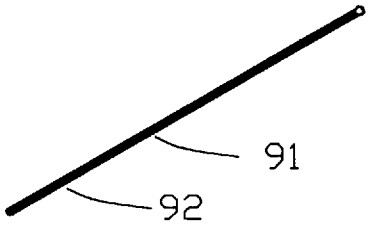
FIG. 22 is an isometric view of the plurality of the fine metallic fibers of FIG. 21 after chemical removal of the coating material.
Figure 22A:
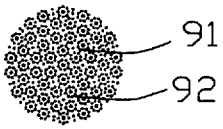
FIG. 22A is an enlarged end view of FIG. 22.

FIG. 22 is an isometric view of the first and second plurality of the fine metallic fibers 91 and 92 of FIG. 21 after the process step 16 of removing the unitary material 70. FIG. 22A is an enlarged end view of FIG. 22. Preferably, the unitary material 70 is removed by an acid leaching process for dissolving the copper coatings 31 and 32 and casing 33 to provide a plurality of the first and second plurality of fine metallic fibers 91 and 92.

Figure 23:
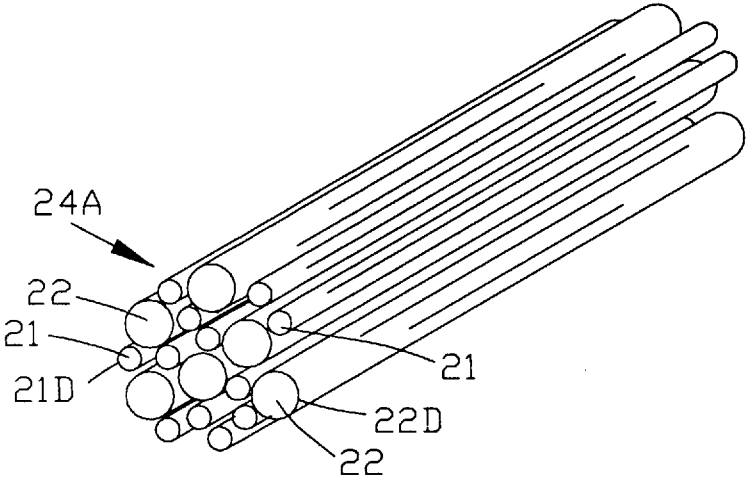
FIG. 23 is an isometric view of a second example of an assembly of a multiplicity of mixed first and second coated metallic wires.

FIG. 23 is an isometric view of a second example of an assembly 24A of a plurality of first and second metallic wires 21 and 22. The first metallic wires 21 have a first diameter 21D whereas the second metallic wires 22 have a second diameter 22D. In addition, the first metallic wires may be of a different composition than the second metallic wire 22. The first and second metallic wires 21 and 22 form a mixed assembly 24A suitable for use as the assemblies 24 set forth in FIGS. 13–22. In this example, the first and second metallic wires 21 and 22 are randomly located within the assembly 24A.

Figure 24:
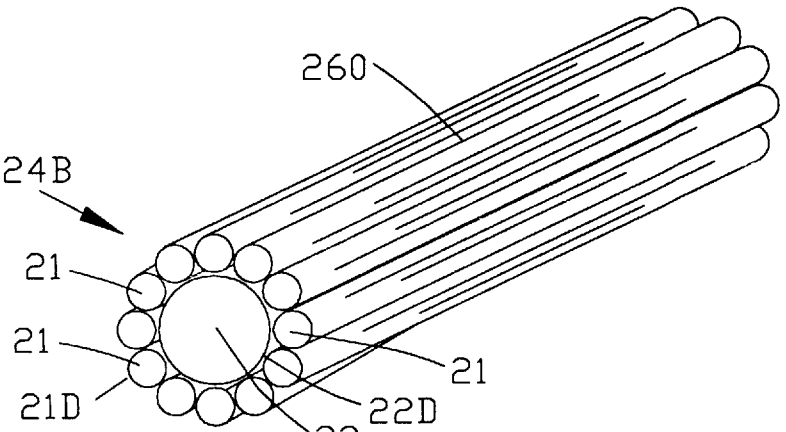
FIG. 24 is an isometric view of a third example of an assembly of a multiplicity of mixed first and second coated metallic wires.

FIG. 24 is an isometric view of a third example of an assembly 24B of a plurality of first and second metallic wires 21 and 22. The first metallic wires 21 have a first diameter 21D whereas the second metallic wires 22 have a second diameter 22D. In this example, the ratio of the first and second metallic wires 21 and 22 is altered relative to the assembly 24 of FIG. 13.

In addition, the plurality of first and second metallic wires 21 and 22 are twisted to form a strand 260. The strand 260 comprises a twisted array 24B of the plurality of first and second metallic wires 21 and 22. Preferably, the first and second metallic wires 21 and 22 are twisted into a helical pattern to provide the strand 260 at the rate of 1.5 turns per 2.5 centimeters. The strand 260 may be coiled for on a spool (not shown) for temporary storage. A multiplicity of the stands 260 may be collected from a multiplicity of the spools (not shown) for forming an array of the strands 260. The array of the strands 260 may be used during the process step 12 of FIG. 12.

Figure 25:
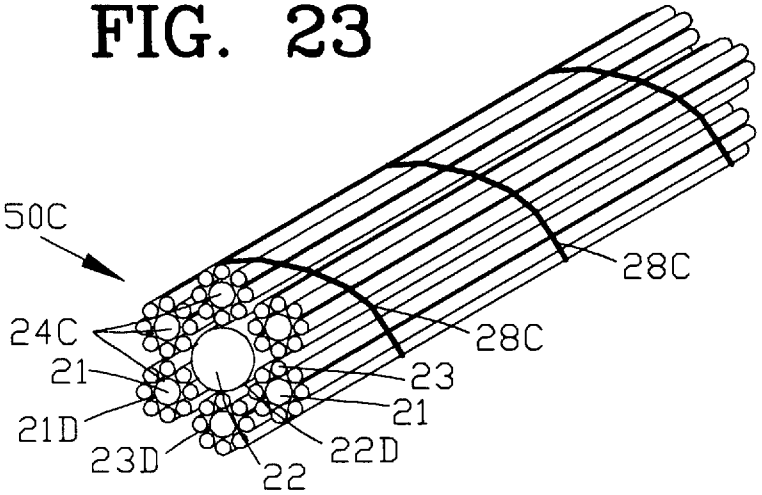
FIG. 25 is an isometric view of a fourth example of an array of a multiplicity of assemblies of the first and second coated metallic wires.

FIG. 25 is an isometric view of a fourth example of an array 50C of assemblies 24C of a first, a second and a third coated metallic wire 21, 22 and 23. The first metallic wires 21 have a first diameter 21D, the second metallic wires 22 have a second diameter 22D and the third metallic wires 23 have a third diameter 23D. In this example, each of the array 50C of the assemblies 24C are bound with a wrapping material 28C for maintaining the integrity of the assembly 24C during the process step 12 in FIG. 12. Preferably, the wrapping material 28C is the same material as the coating materials 31 and 32.

Figure 26:
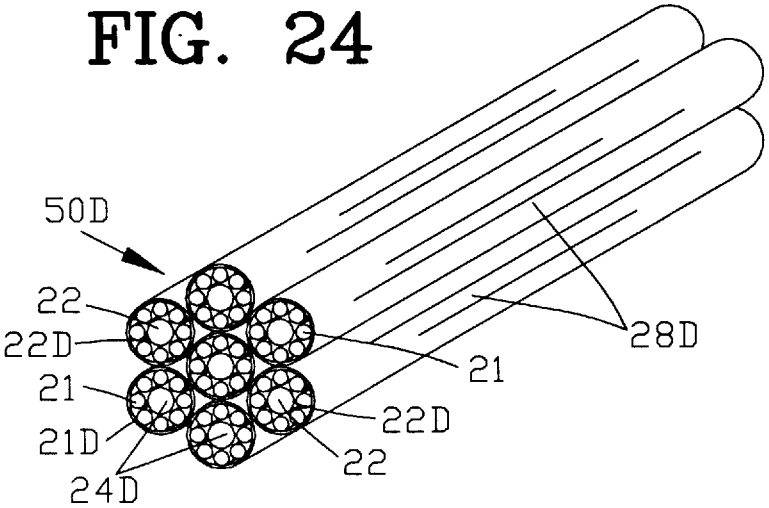
FIG. 26 is an isometric view of a fifth example of an array of a multiplicity of assemblies of the first and second coated metallic wires.

FIG. 26 is an isometric view of a fifth example of an array 50D of assemblies 24D of the first, second and third plurality of metallic wires 21, 22 and 23. In this example, a wrapping material 28D binds each of the plurality of assemblies 24D of the first, second and third coated metallic wires 21, 22 and 23. The wrapping material 28D is shown as a continuous sheet of wrapping material 28D for providing a plurality of bound assemblies 24D. Preferably, the wrapping material 28D is made from the same material as the coating materials 31 and 32.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A process for making fine metallic fibers comprising:

coating a plurality of metallic wires with a coating material;

jacketing the plurality of metallic wires with a tube for providing a cladding;

drawing the cladding for reducing the outer diameter thereof and for reducing the cross-section of each of the plurality of metallic wires within the cladding and for diffusion welding the coating material within the cladding to form a substantially unitary coating material with the plurality of metallic wires contained therein;

mechanically removing the tube to provide a remainder comprising the diffusion welded coating material with the plurality of metallic wires contained therein;

drawing the remainder for reducing the diameter thereof and for reducing the corresponding cross-section of each of the plurality of metallic wires contained therein to transform the plurality of metallic wires into a plurality of fine metallic fibers; and chemically dissolving the diffusion welded coating material from the remainder for providing the plurality of fine metallic fibers.

2. A process for making fine metallic fibers as set forth in claim 1, wherein the step of coating the plurality of metallic wires with a coating material includes electroplating the coating material onto the plurality of metallic wires.

3. A process for making fine metallic fibers as set forth in claim 1, wherein the step of coating a plurality of metallic wires with a coating material includes coating a first plurality of metallic wires and coating a second plurality of metallic wires.

4. A process for making fine metallic fibers as set forth in claim 1, wherein the step of coating a plurality of metallic wires with a coating material includes coating a first plurality of metallic wires and coating a second plurality of metallic wires with the first plurality of metallic wires having a smaller diameter than the second plurality of metallic wires.

5. A process for making fine metallic fibers as set forth in claim 1, including the step of forming the plurality of metallic wires into a plurality of assemblies of metallic wires;

binding each of the plurality of assemblies of metallic wires with a wrapping material for providing a plurality of bound assemblies; and the step of jacketing the plurality of metallic wires with a tube including jacketing the plurality of bound assemblies with the tube for providing the cladding.

6. A process for making fine metallic fibers as set forth in claim 1, including the step of forming the plurality of metallic wires into a plurality of assemblies of metallic wires;

binding each of the plurality of assemblies of metallic wires within a wrapping wire for providing a plurality of bound assemblies; and the step of jacketing the plurality of metallic wires with a tube including jacketing the plurality of bound assemblies with the tube for providing the cladding.

7. A process for making fine metallic fibers as set forth in claim 1, including the step of forming the plurality of metallic wires into a plurality of assemblies of metallic wires;

binding each of the plurality of assemblies of metallic wires within a continuous sheet of wrapping material for providing a plurality of bound assemblies; and the step of jacketing the plurality of metallic wires with a tube includes jacketing the plurality of bound assemblies with the tube for providing the cladding.

8. A process for making fine metallic fibers as set forth in claim 1, including the step of encasing the plurality of coated metallic wires with a casing material for providing a casing; and the step of jacketing the plurality of metallic wires with a tube including jacketing the casing with the tube for providing the cladding.

9. A process for making fine metallic fibers as set forth in claim 1, including the step of encasing the plurality of coated metallic wires with a continuous sheet of casing material for providing a casing; and the step of jacketing the plurality of metallic wires with a tube including jacketing the casing material with the tube for providing the cladding.

10. A process for making fine metallic fibers as set forth in claim 1, including the step of treating an interior of the tube with a release material to inhibit chemical interaction between the tube and the plurality of coated metallic wires within the tube.

11. A process for making fine metallic fibers as set forth in claim 1, including the step of treating an interior of the tube with a release material with a quantity sufficient to inhibit chemical interaction between the tube and the plurality of coated metallic wires within the tube and with the quantity of the release material being insufficient to inhibit the diffusion weld of the coating materials on adjacent coated metallic wires.

12. A process for making fine metallic fibers as set forth in claim 1, including the step of treating an interior of the tube with a release material by painting the release material onto the interior of the tube.

13. A process for making fine metallic fibers as set forth in claim 1, wherein the step of jacketing the plurality of metallic wires with the tube includes inserting the plurality of coated metallic wires into a preformed tube.

14. A process for making fine metallic fibers as set forth in claim 1, wherein the step of jacketing the plurality of metallic wires with the tube includes simultaneously inserting the plurality of metallic wires into a preformed tube.

15. A process for making fine metallic fibers as set forth in claim 1, wherein the step of jacketing the plurality of metallic wires with the tube includes forming a longitudinally extending sheet of cladding material into a tube about the plurality of metallic wires.

16. A process for making fine metallic fibers as set forth in claim 15, wherein the step of mechanically removing the tube comprises cutting the tube and peeling the tube from the remainder.

17. A process for making fine metallic fibers as set forth in claim 1, wherein the step of jacketing the plurality of metallic wires with the tube includes bending a first and a second edge of a longitudinally extending sheet of cladding material to form the tube with the first edge of the cladding material abutting the second edge of the cladding material; and welding the first edge of the cladding material abutting to the second edge of the cladding material.

18. A process for making fine metallic fibers as set forth in claim 1, wherein the step of chemically dissolving the diffusion welded coating material includes immersing the remainder into an acid for dissolving the diffusion welded coating material for providing the plurality of fine metallic fibers.

19. A process for making fine metallic fibers comprising:

coating a plurality of metallic wires with a coating material;

treating an interior of a jacketing material with a release material to inhibit chemical interaction between the jacketing material and the Plurality of coated metallic wires;

jacketing the plurality of metallic wires with a tube formed from the jacketing material for providing a cladding;

drawing the cladding for reducing the outer diameter thereof and for reducing the cross-section of each of the plurality of metallic wires within the cladding and for diffusion welding the coating material within the cladding to form a substantially unitary coating material with the plurality of metallic wires contained therein;

mechanically removing the tube to provide a remainder comprising the diffusion welded coating material with the plurality of metallic wires contained therein;

drawing the remainder for reducing the diameter thereof and for reducing the corresponding cross-section of each of the plurality of metallic wires contained therein to transform the plurality of metallic wires into a plurality of fine metallic fibers; and chemically dissolving the diffusion welded coating material from the remainder for providing the plurality of fine metallic fibers.

20. A process for making fine metallic fibers comprising:

coating a plurality of metallic wires with a coating material;

treating an interior of a jacketing material with a release material to inhibit diffusion welding between the jacketing material and the plurality of coated metallic wires;

jacketing the plurality of metallic wires with a tube formed from the jacketing material for providing a cladding;

drawing the cladding for reducing the outer diameter thereof and for reducing the cross-section of each of the plurality of metallic wires within the cladding and for diffusion welding the coating material within the cladding to form a substantially unitary coating material with the plurality of metallic wires contained therein;

mechanically removing the tube to provide a remainder comprising the diffusion welded coating material with the plurality of metallic wires contained therein;

drawing the remainder for reducing the diameter thereof and for reducing the corresponding cross-section of each of the Plurality of metallic wires contained therein to transform the plurality of metallic wires into a plurality of fine metallic fibers; and chemically dissolving the diffusion welded coating material from the remainder for providing the plurality of fine metallic fibers.

21. A process for making fine metallic fibers comprising:

coating a plurality of metallic wires with a coating material;

inserting the plurality of metallic wires within a tube for providing a cladding;

drawing the cladding for reducing the outer diameter thereof and for reducing the cross-section of each of the plurality of metallic wires within the cladding and for diffusion welding the coating material within the cladding to form a substantially unitary coating material with the plurality of metallic wires contained therein;

mechanically removing the tube to provide a remainder comprising the diffusion welded coating material with the plurality of metallic wires contained therein;

drawing the remainder for reducing the diameter thereof and for reducing the corresponding cross-section of each of the plurality of metallic wires contained therein to transform the plurality of metallic wires into a plurality of fine metallic fibers; and chemically dissolving the diffusion welded coating material from the remainder for providing the plurality of fine metallic fibers.

22. A process for making fine metallic fibers comprising:

coating a plurality of metallic wires with a coating material;

forming a continuous tube about the plurality of metallic wires for providing a cladding;

drawing the cladding for reducing the outer diameter thereof and for reducing the cross-section of each of the plurality of metallic wires within the cladding and for diffusion welding the coating material within the cladding to form a substantially unitary coating material with the plurality of metallic wires contained therein, mechanically removing the tube to provide a remainder comprising the diffusion welded coating material with the plurality of metallic wires contained therein;

drawing the remainder for reducing the diameter thereof and for reducing the corresponding cross-section of each of the plurality of metallic wires contained therein to transform the plurality of metallic wires into a plurality of fine metallic fibers; and chemically dissolving the diffusion welded coating material from the remainder for providing the plurality of fine metallic fibers.

23. A process for making fine metallic fibers comprising:

coating a plurality of first metallic wires with a coating material to provide a first plurality of coated wires;

coating a plurality of second metallic wires with a coating material to provide a second plurality of coated wires;

assembling the first and second plurality of coated wires;

jacketing the assembling of the first and second plurality of coated wires with tube for providing a cladding;

drawing the cladding for reducing the outer diameter thereof and for reducing the cross-sections of each of the first plurality of metallic wires within the cladding and for reducing the cross-section of each of the second plurality of metallic wires within the cladding and for diffusion welding the coating material within the cladding to form a substantially unitary coating material with the first and second plurality of metallic wires contained therein;

mechanically removing the tube to provide a remainder comprising the diffusion welded coating material with the first and second plurality of metallic wires contained therein;

drawing the remainder for reducing the diameter thereof and for reducing the corresponding cross-section of each of the first plurality of metallic wires contained within the remainder and for reducing the corresponding cross-section of each of the second plurality of metallic wires contained within the remainder to transform the first and second plurality of metallic wires into a first and second plurality of fine metallic fibers; and chemically dissolving the diffusion welded coating material for providing a mixture of the first and second plurality of fine metallic fibers.

24. A process for making fine metallic fibers comprising:

coating a plurality of metallic wires with a coating material;

encasing a plurality of metallic wires with a casing material for providing a casing;

jacketing the casing with a tube to provide a cladding;

drawing the cladding for reducing the outer diameter thereof and for reducing the cross-section of each of the plurality of metallic wires within the cladding and for diffusion welding the coating material and the casing material within the cladding to form a substantially unitary coating material with the plurality of metallic wires contained therein;

mechanically removing the tube to provide a remainder comprising the diffusion welded coating material and the diffusion welded casing material with the plurality of metallic wires contained therein;

drawing the remainder for reducing the diameter thereof and for reducing the corresponding cross-section of each of the plurality of metallic wires contained therein to transform the plurality of metallic wires into a plurality of fine metallic fibers; and chemically dissolving the diffusion welded coating material and the diffusion welded casing material from the remainder for providing the plurality of fine metallic fibers.

25. A process for making fine metallic fibers comprising:

coating a plurality of metallic wires with a coating material;

forming the plurality of metallic wires into a plurality of assemblies of metallic wires;

binding each of the plurality of assemblies of metallic wires with a wrapping material for providing a plurality of bound assemblies;

forming a plurality of the assemblies;

encasing the plurality of the assemblies with a casing material for providing a casing;

jacketing the casing with a tube to provide a cladding;

drawing the cladding for reducing the outer diameter thereof and for reducing the cross-section of each of the plurality of metallic wires within the cladding and for diffusion welding the coating material and the wrapping material and the casing material within the cladding to form a substantially unitary material comprising the coating material and the wrapping material and the casing material with the plurality of metallic wires contained therein;

mechanically removing the cladding material to provide a remainder comprising the diffusion welded coating material and the wrapping material and the casing material with the plurality of metallic wires contained therein;

drawing the remainder for reducing the diameter thereof and for reducing the corresponding cross-section of each of the plurality of metallic wires contained therein to transform the plurality of metallic wires into a plurality of fine metallic fibers; and chemically dissolving the diffusion welded coating material and the wrapping material and the casing material from the remainder for providing the plurality of fine metallic fibers.

26. A process for making fine metallic fibers comprising:

coating a plurality of stainless steel wires with a copper coating material;

inserting the plurality of stainless steel within a carbon steel tube for providing a cladding;

drawing the cladding for reducing the outer diameter thereof and for reducing the cross-section of each of the plurality of stainless steel wires within the cladding and for diffusion welding the copper coating material within the cladding to form a substantially unitary copper coating material with the plurality of stainless steel wires contained therein;

mechanically removing the carbon steel tube to provide a remainder comprising the diffusion welded copper coating material with the plurality of stainless steel wires contained therein;

drawing the remainder for reducing the diameter thereof and for reducing the corresponding cross-section of each of the plurality of stainless steel contained therein to transform the plurality of stainless steel wires into a plurality of fine stainless steel fibers; and chemically dissolving the diffusion welded copper coating material from the remainder for providing the plurality of fine stainless steel fibers.

27. A process for making fine metallic fibers as set forth in claim 26, wherein the step of coating the plurality of metallic wires with a coating material includes electroplating copper onto the plurality of stainless steel wires.

28. A process for making fine metallic fibers as set forth in claim 26, wherein the step of coating the plurality of metallic wires with a coating material includes electroplating copper onto stainless steel wire having a diameter of 0.028 cm to 0.08 cm with copper having a thickness of 20 $\mu$m–50 $\mu$m.

29. A process for making fine metallic fibers as set forth in claim 26, wherein the step of encasing the plurality of metallic wires within the tube includes simultaneously inserting the plurality of copper coated stainless steel wires into a preformed carbon steel tube; and the step of removing the coating material includes immersing the remainder into a solution of 8% to 15% $H_2SO_4$ and 0.1% to 1.0% $H_2O_2$ for dissolving the copper coating without dissolving the stainless steel fibers.

* * * * *